United States Patent [19]

Ripley

[11] Patent Number: 5,024,410

[45] Date of Patent: Jun. 18, 1991

[54] REAL ESTATE SIGN FASTENER

[76] Inventor: Donald W. Ripley, 10234 E. Emily Pl., Tucson, Ariz. 85730

[21] Appl. No.: 473,811

[22] Filed: Feb. 2, 1990

[51] Int. Cl.[5] ..... A47H 1/16

[52] U.S. Cl. ..... 248/302; 40/606; 211/119

[58] Field of Search ..... 248/303, 302, 211, 213, 248/214, 215, 304; 40/606; 211/119; 24/555, 559, 237, 230.5 R, 230.5 AD, 230.5 W, 230.5 TP, 710.2

[56] References Cited

U.S. PATENT DOCUMENTS 280,434 7/1883 Zahm ..... 248/302 X
427,583 5/1890 Lawrence ..... 248/302 X
2,163,936 6/1939 Cunningham ..... 24/710.2 X
2,733,038 1/1956 Zelt ..... 248/302 X

FOREIGN PATENT DOCUMENTS 16016 11/1881 Fed. Rep. of Germany ..... 24/710.2

*Primary Examiner*—J. Franklin Foss
*Attorney, Agent, or Firm*—John P. Halvonik

[57] ABSTRACT

The device is a sign fastening device that is meant to be used to attach one sign to another one above it. The device is a specially shaped wire that can be effectively used on the standard signs that are used in the real estate industry. These signs have holes in the top and bottom edges that can be ideally joined with the device of the present invention.

1 Claim, 1 Drawing Sheet

REAL ESTATE SIGN FASTENER

BACKGROUND OF THE INVENTION

1. Field of the Invention

The device relates to the field of sign fasteners and in particular, a wire fastener of a special design that is used to attach commonly used real estate signs above and below each other.

2. Description of the Prior Art

While there are similar devices that are used to attach various things to one another, there is none that applicant is aware of this particular design that is used to hold real estate signs together.

SUMMARY OF THE INVENTION

The invention is intended to be a hold down clip for real estate signs and similar signs. It is of a specially constructed shape that permits it to reliably secure real estate signs to one another with as little effort and time as possible. The attachment is usually made of wire bent upon itself and has a curved portion at one end that allows the other end to be held to the end with the curved portion. The attaching end is curved away from the sign so that there is little chance of scratching the signs when the clip is used.

It is the object of this invention to provide a sign fastening device that can be used to attach signs with holes in the top and bottom edges to one another, preferably above each other.

It is another objective of the present invention to provide a real estate sign securing device that can be readily attached to a sign above it without the need for special tools.

Still another objective is to provide a sign fastening device that can be used to attach signs with one hand.

Another is to provide a sign fastening device of such design that it will not come unfastened in inclement weather.

Yet another objective of the present invention is to provide a device of simple and inexpensive construction that can be used to secure signs to another and still permit them to swing in a wind.

DRAWINGS

DESCRIPTION OF THE PREFERRED EMBODIMENT

In the real estate world many people find it hard to attach the commonly used signs in that industry to one another. These signs are commonly seen in use in yards and are of the variety of signs that have holes in the top and bottom edges. Usually these signs need to be attached above and below each other while they hang from an advertising sign. An attaching device should permit the signs to swing freely in the wind from the pole or other support device. The holes are used to attach the signs on a post above and below each other. Typically, a wire that may resemble a shower curtain hanging wire or S shaped wire is used to keep the signs together. Pliers are commonly used to attach the signs with this wire.

Real estate agents and women especially, find it difficult to use pliers to bend these S shaped hooks because they are not as strong or mechanically inclined or the weather is inclement. Another problem is that typically the agent has to work with one hand with other tied up with papers, etc. The typical clip used in the real estate industry also has a tendency to come apart in adverse weather. The present invention is meant to overcome these problems with a device that attaches these signs readily and with little effort.

Figure 1:
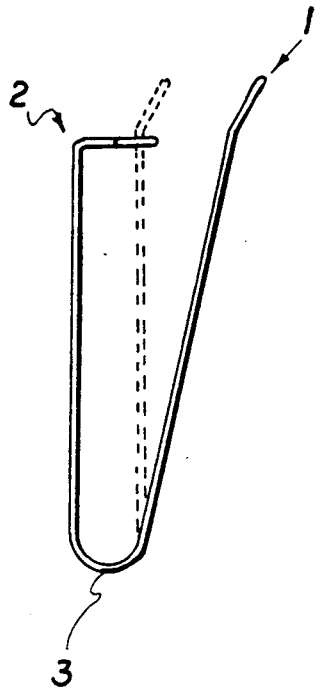
FIG. 1 shows the overall shape of the wire attaching device A is a side view, B is a top view.

The sign clip is in the form of a wire of special shape, see FIG. 1A. The materials used may be any material that can retain its shape throughout the kind of use that real estate signs are put to. This includes inclement weather and hostile outdoor pests. The material should be bendable with effort and able to retain the shape it has been bent into. Preferably the material is tinned stainless steel wire but any wire can be used. Tinned wire provides a brighter finish to the metal.

Figure 1B:
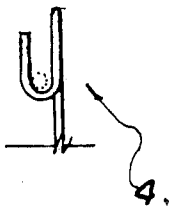

The wire is bent in the middle 3 and specially shaped at the ends. The end that is inserted into the hole in the bottom edge of the already hanging sign is designated the insertion end 2, and is bent at 90 degrees to the main length of the wire. This creates a bent piece at the end of the wire that may be anywhere from a fraction of an inch or several inches long at the insertion end. This portion is in turn bent around itself, preferably in a curved fashion, but even a square shape will do. This curve is shown as 4 in FIG. 1B. The object of the curved portion is to form a hook like extension of the wire that can be used to hold the other end of the wire securely to it. The reason for the 90 degree bend is to facilitate insertion into the sign with the holes since the person holding the wire will then have the opposite end of the wire in position on the other side of the sign to be clipped into the insertion end.

Figure 2:
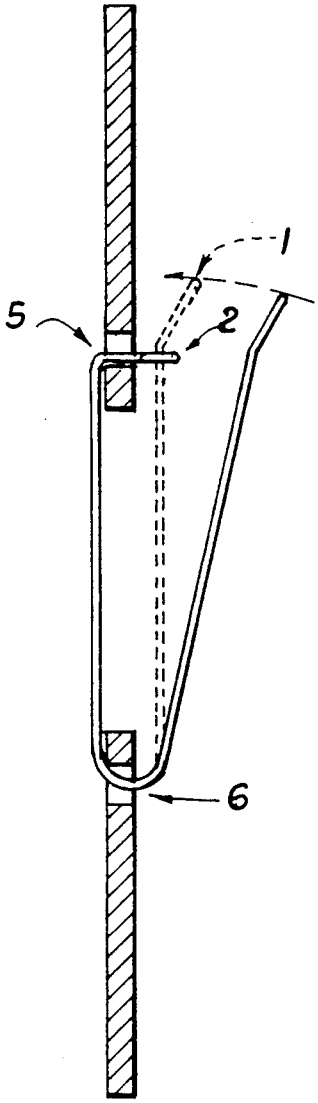
FIG. 2 shows the attaching device in use on signs, side view and top view.
Figure 3:
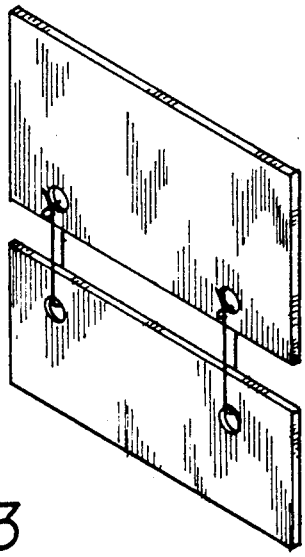
FIG. 3 shows comparative size and uses.

The other end of the wire is designated the attaching end 1 and is placed in the hole in the top edge of the sign that is to be attached see 6 in FIG. 2 side view. As the wire is bent in half originally, this end is parallel to the main length of the wire and is opposite the insertion end of the wire. The attaching end is bent away from the wire at an amount sufficient to prevent the sign from being scratched while in the process of attaching the signs.

To use the clip the insertion end 2, is placed in the bottom hole of the sign that is already hanging 5 in FIG. 2. The attaching end is then placed through the top hole of the bottom sign and then brought up toward the insertion end by being squeezed or other wise brought to the vicinity of the curved portion and then released so that it will stay with in the curved portion. This operation can be done with one hand while the other is in the process of holding papers etc. To remove, the wire is again squeezed so that it comes out of the curved portion and is then released from the sign because it is out of reach of the curved portion.

I claim:

1. A real estate sign display apparatus comprising:

First real estate sign having top and bottom edges and having circular holes located near the top and bottom edges of said sign;

support means having horizontal support member, said horizontal member capable of holding said first real estate sign from said holes located near the top edge of said sign;

second real estate sign having top and bottom edges and having circular holes located near the top and bottom edges of said sign;

attaching means comprising wire member bent near the middle of said member and having blunt ends, so as to form two. substantially parallel, wire portions, first parallel wire portion having J shaped portion near the end of said wire and said J shape defining a plane that is perpendicular to said parallel wire portions, second parallel wire portion having end bent away from said first parallel wire portion, so that said attaching means may join said signs together through said circular holes located near said bottom and said top edges via inserting said wire member through said circular holes located near said top edge of said second sign and through said circular holes located near said bottom edge of said first sign and joining said bent away portion within said J shaped portion.

* * * * *